US008561971B2

(12) United States Patent
Levien et al.

(10) Patent No.: US 8,561,971 B2
(45) Date of Patent: Oct. 22, 2013

(54) CARBURETOR

(75) Inventors: Patrick Levien, Fellbach (DE); Alexander Kraus, Göppingen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 202 days.

(21) Appl. No.: 13/267,005

(22) Filed: Oct. 6, 2011

(65) Prior Publication Data

US 2012/0091599 A1 Apr. 19, 2012

(30) Foreign Application Priority Data

Oct. 16, 2010 (DE) ..... 10 2010 048 773

(51) Int. Cl.
*F02M 17/40* (2006.01)

(52) U.S. Cl.
USPC ..... 261/52; 261/64.1; 261/65

(58) Field of Classification Search
USPC ..... 261/23.2, 23.3, 52, 61, 64.1, 65, DIG. 1
See application file for complete search history.

(56) References Cited

U.S. PATENT DOCUMENTS

| | | | | |
|---|---|---|---|---|
| 3,677,241 | A * | 7/1972 | Gele et al. | 123/327 |
| 3,807,710 | A * | 4/1974 | Bergamini | 261/39.2 |
| 4,351,782 | A * | 9/1982 | Bellicardi et al. | 261/39.2 |
| 4,524,742 | A * | 6/1985 | Bonfiglioli et al. | 123/438 |
| 5,200,118 | A | 4/1993 | Hermle | |
| 6,848,405 | B1 | 2/2005 | Dow et al. | |
| 6,913,250 | B2 * | 7/2005 | Osburg et al. | 261/35 |
| 7,118,097 | B2 * | 10/2006 | Moriyama et al. | 261/39.4 |
| 8,297,598 | B2 * | 10/2012 | Chen | 261/35 |
| 2003/0052422 | A1 | 3/2003 | Schliemann | |
| 2005/0034689 | A1 | 2/2005 | Toda et al. | |
| 2005/0194701 | A1 * | 9/2005 | Moriyama et al. | 261/39.4 |
| 2006/0138684 | A1 * | 6/2006 | Prager et al. | 261/52 |
| 2006/0208371 | A1 * | 9/2006 | Suzuki et al. | 261/39.1 |
| 2010/0283161 | A1 | 11/2010 | Hänssler et al. | |
| 2012/0043674 | A1 * | 2/2012 | Pattullo et al. | 261/23.3 |

FOREIGN PATENT DOCUMENTS

JP 54-40929 A * 3/1979

* cited by examiner

*Primary Examiner* — Richard L Chiesa
(74) *Attorney, Agent, or Firm* — Gudrun E. Huckett

(57) ABSTRACT

A carburetor has a throttle element rotatably supported on a throttle shaft and a choke element rotatably supported on a choke shaft. A first coupling element is fixedly connected to the throttle shaft. A second coupling element is connected to the choke shaft. The first and second coupling elements define in a locked position a start position of throttle element and choke element. The locked position is released by rotation of the throttle shaft in opening direction of the throttle element. The locked position is released by rotation of the choke shaft in opening direction of the choke element. One of the first and second coupling elements is an at least partially elastic coupling element. Upon rotation of the choke shaft from the locked position into an open position, the elastic coupling element is elastically deformed and releases the locked position between the first and second coupling elements.

16 Claims, 5 Drawing Sheets

CARBURETOR

BACKGROUND OF THE INVENTION

The invention relates to a carburetor comprising a throttle element that is rotatably supported on a throttle shaft and comprising a choke element that is rotatably supported on a choke shaft, further comprising a first coupling element that is fixedly connected to the throttle shaft and a second coupling element that is connected to the choke shaft, wherein the first coupling element and the second coupling element in at least one locked position define a start position of throttle element and choke element, wherein the locked position by rotation of the throttle shaft in opening direction of the throttle element can be released, and wherein the locked position by rotation of the choke shaft in opening direction of the choke element can be released.

US 2010/0283161 A1 discloses a carburetor where the throttle lever and the choke lever define the start positions of throttle flap and choke flap. In order to be able to release the locking action by adjustment of the operating state selector and not solely by acceleration, an axial displacement of the choke lever on the choke shaft is possible.

It is the object of the present invention to provide a carburetor of the aforementioned kind that is of a simple configuration and has a small size.

SUMMARY OF THE INVENTION

In accordance with the present invention, this is achieved in that one of the two coupling elements is at least partially of an elastic configuration and in that upon rotation of the choke shaft from the locked position into the open position the elastic coupling element is elastically deformed and in this way the locked position between the coupling elements is released.

Since at least one of the two coupling elements is at least partially of an elastic configuration and, upon rotation of the choke shaft in opening direction, i.e., in case of an emergency release, is elastically deformed, no constructive space for an axial displacement or a tilting movement of the coupling element is required. A simple configuration and a minimal size are provided.

Advantageously, the coupling element has a hook-shaped section that is elastic. A high elasticity is achieved because of the hook-shaped configuration. The hook-shaped section forms also a beneficial contour for a locking action of the two coupling elements. Advantageously, the elastic coupling element is comprised at least partially, in particular completely, of plastic material. The plastic material polyoxymethylene (POM) is advantageous in this connection. The other coupling element is advantageously shape-stable with regard to the forces that usually occur in operation. The elastic coupling element is thus deformed by the shape-stable coupling element. Since one of the coupling elements is shape-stable, one or several locked positions can be defined comparatively precisely. Advantageously, the first coupling element that is connected to the throttle shaft is elastic and the second coupling element that is connected to the choke shaft is shape-stable. The coupling elements are formed in particular as levers.

In order to avoid that the operator accidentally adjusts the start position, it is desirable that the operator first must accelerate (actuate the trigger), i.e., must open the throttle element and subsequently engage the choke, i.e., pivot the choke element. In order to ensure this operational sequence, it is provided that the first coupling element has a locking contour that interacts with a locking section of the second coupling element and that blocks, when the throttle element is closed, the second coupling element and prevents rotation of the choke shaft in opening direction. A simple configuration results when the hook-shaped section forms the locking contour. In this way, without additional components a desired operating sequence can be predetermined by constructive means in a simple way.

The coupling elements are usually subject to manufacturing tolerances. In order to ensure despite of this a safe locking action of choke element and throttle element, a device for compensation of the manufacturing tolerances is provided. It is provided in this connection that on the choke shaft an intermediate lever is fixedly arranged and that the second coupling element is supported rotatably on the choke shaft and is coupled with the intermediate lever by means of a coupling device. In this connection, the coupling device enables a limited movability of the second coupling element relative to the intermediate lever in at least one direction. In this way, it can be ensured, on the one hand, that also for unfavorable manufacturing tolerances a locked position between the two coupling elements is always reached. On the other hand, it can be ensured that the choke element when the choke is engaged is reliably closed. Advantageously, the coupling device delimits the movability of the second coupling element relative to the intermediate lever in both rotational directions. In one rotational direction the second coupling element entrains the intermediate lever upon engaging the choke. In the opposite direction, entrainment of the second coupling element by means of the intermediate lever is desirable in order to be able, in case of an iced choke element or the like, to pull off the choke by means of the intermediate lever.

A simple constructive embodiment results when the coupling device is formed by a pin that projects into an opening wherein the extension of the pin in the circumferential direction of the choke shaft is smaller than the opening. The play between pin and opening in the circumferential direction ensures the limited movability of the second coupling element relative to the intermediate lever. Advantageously, the pin is formed on the second coupling element and the opening on the intermediate lever. However, it may also be advantageous to form the pin on the intermediate lever and the opening on the second coupling element. In a configuration of the second coupling element and intermediate lever as sheet metal parts, the pin and the opening can be produced in a simple way in a manufacturing process by stamping or bending. Advantageously, in the direction of action between the second coupling element and the intermediate lever a coupling spring is arranged. In this way, the choke element can be safely closed, namely in the context of the limited movability that is enabled by the coupling device, independent of the existing manufacturing tolerances. Advantageously, the coupling spring secures the intermediate lever in axial direction. In this way, an additional securing element is not needed. A simple configuration results when the intermediate lever and the second coupling element are comprised of a shape-stable material, in particular of metal or a shape-stable plastic material. Shape-stable plastic material as a material for the intermediate lever and/or the second coupling element is particularly advantageous in order to achieve together with other components such as, for example, a shifting shaft, a beneficial sliding pair.

Advantageously, the first coupling element is secured on the throttle shaft by means of a fastening screw. The fastening screw extends advantageously in approximately radial direction relative to the axis of rotation of the throttle shaft.

DESCRIPTION OF THE PREFERRED EMBODIMENTS

Figure 1:
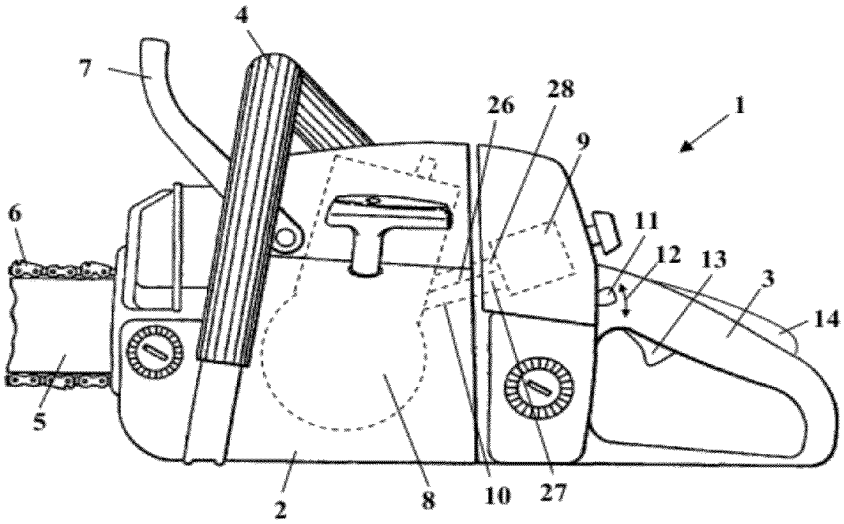
FIG. 1 is a schematic side view of a motor chainsaw.

FIG. 1 shows the embodiment of a hand-held power tool in the form of a motor chainsaw 1. The carburetor of the present invention can however also be used in other hand-held power tools driven by internal combustion engines such as cut-off machines, trimmers or the like.

The motor chainsaw 1 has a housing 2 on which a rear handle 3 and a grip pipe 4 are attached by means of antivibration elements, not illustrated. On the front side of the housing 2 that is facing away from the rear handle 3, a guidebar 5 projects forwardly on which a saw chain 6 is arranged. The saw chain 6 is driven in circulation by an internal combustion engine 8 arranged in the housing 2. The internal combustion engine 8 is advantageously a two-stroke engine, in particular a two-stroke engine that operates with scavenging air. On the side of the grip pipe 4 that is facing the saw chain 6 a hand guard 7 is arranged on the housing 2.

The internal combustion engine 8 is connected by an intake passage 10 to a carburetor 9. In the illustrated embodiment, the internal combustion engine 8 is embodied as a two-stroke engine operating with scavenging air. The intake passage 10 is separated by a partition 26 into an air passage 27 and a mixture passage 28. On the side of the housing 2 that is facing the rear handle 3 an operating state selector 11 is supported so as to be pivotable in the direction of arrow 12. On the rear handle 3 there is also the accelerator lever (trigger) 13 as well as a trigger lock 14.

The operating state selector 11 has several positions, i.e., a stop position, an operating position as well as a start position. The operating state selector 11 acts on the carburetor 5 as well as on an ignition switch of the internal combustion engine 8. In the stop position, the ignition switch is short-circuited so that no spark can be produced.

Figure 2:
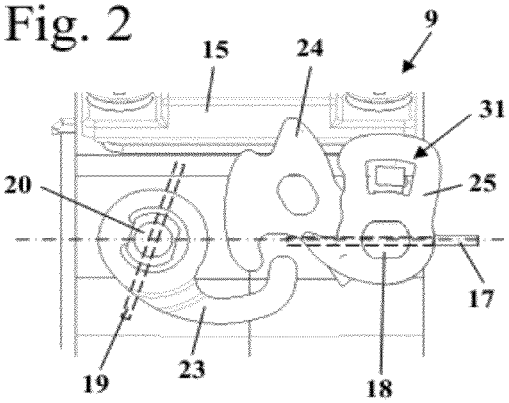
FIG. 2 is a side view of the carburetor in idle position.
Figure 3:
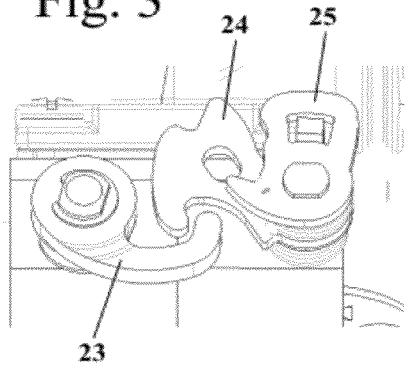
FIG. 3 is a perspective side view of the carburetor in the position of FIG. 2.
Figure 4:
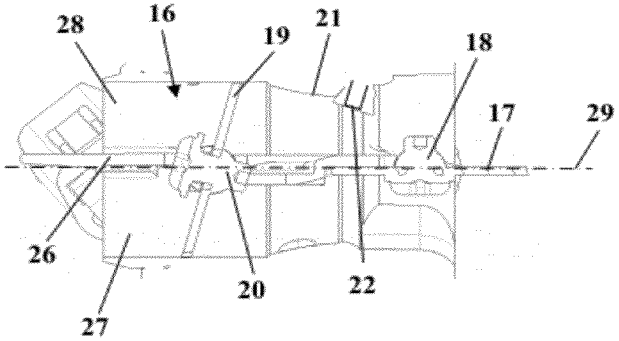
FIG. 4 is a section view of the carburetor in the position of FIG. 2.

FIGS. 2 to 4 show the carburetor 5 at idle. In this position of the carburetor, the operating state selector 11 is arranged in the operating position and the accelerator lever (trigger) 13 is not actuated by the operator.

The carburetor 9 has a carburetor housing 15 in which an intake passage section 16 (FIG. 4) is formed. In the intake passage section 16 a venturi 21 is formed where a fuel port 22 opens into the mixture passage 28. In the intake passage section 16 a choke valve 17 with a choke shaft 18 as well as, downstream of the choke valve 17, a throttle valve 19 with a throttle shaft 20 are pivotably supported. The partition 26 extends in the area between throttle shaft 20 and choke shaft 18 and also downstream of the throttle shaft 20. The intake passage 10 has a longitudinal intake passage axis 29 which is approximately perpendicular to the pivot axes of throttle shaft 20 and choke shaft 18.

As shown in FIGS. 2 and 3, on the exterior side of the carburetor housing 15 a throttle lever 23, a choke lever 24 as well as an intermediate lever 25 are provided. The throttle lever 23 is arranged fixedly on the throttle shaft 20, i.e., rotates with the shaft 20. The intermediate lever 25 is fixedly arranged on the choke shaft 18, i.e., rotates with the shaft 18. The choke lever 24 is supported rotatably relative to the choke shaft 18 and is connected with the intermediate lever 25 by means of a coupling device 31 to be described in the following in more detail. In the idle position, shown in FIGS. 2 and 3, the throttle lever 23 and the choke lever 24 are disengaged.

In the idle position illustrated in FIGS. 2 and 3, the operator can actuate the trigger 13 and pivot in this way the throttle shaft 20, the throttle valve 19 and the throttle lever 23. The throttle lever 23 can pivot without being hindered by choke lever 24 and intermediate lever 25.

Figure 5:
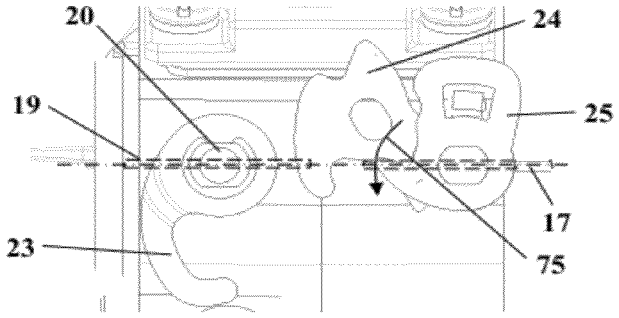
FIG. 5 shows the carburetor of FIG. 2 in full load position.
Figure 6:
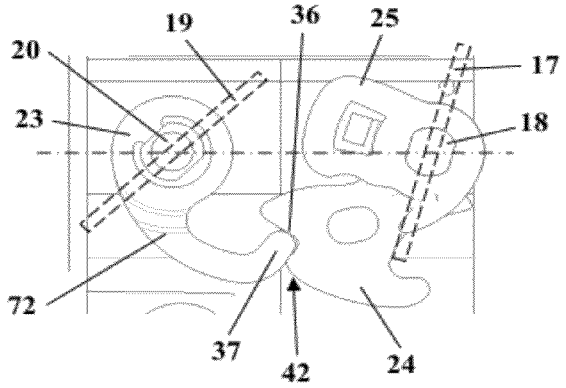
FIG. 6 shows the carburetor of FIG. 2 in start position.

For shifting into the start position illustrated in FIG. 6, the operating state selector 11 has been pivoted from the operating position into the start position; this is done after the trigger 13 has been suppressed and in this way the throttle lever 23 has been moved into the position illustrated in FIG. 5. In this way, an unhindered pivoting of the choke lever 24 with the intermediate lever 25 in the direction of arrow 75 illustrated in FIG. 5 is possible. In the start position illustrated in FIG. 6 the choke valve 17 is completely dosed. The throttle valve 19 is in a central position and closes the intake passage 10 partially. In this position, the throttle lever 23 and the choke lever 24 are locked with each other in locked position 42. The throttle lever 23 has a hook-shaped section 72 that is approximately L-shaped. The short leg 37 of the hook-shaped section 72 projects in the locked position 42 into a locking recess 36 on the circumference of the choke lever 24. The throttle valve 19 is spring-loaded in the direction toward its completely open position, in FIG. 6 counterclockwise, and the choke lever 24 is spring-loaded in the direction toward the completely open position of the choke valve 17, in FIG. 6 clockwise. As a result of the spring loading of the throttle lever 23 and choke lever 24 or throttle shaft 20 and choke shaft 18, the levers are secured in the locked position 42. As is shown in the Figures, the throttle valve 19 and choke valve 17 open in the same direction, i.e., clockwise in the Figures.

Figure 7:
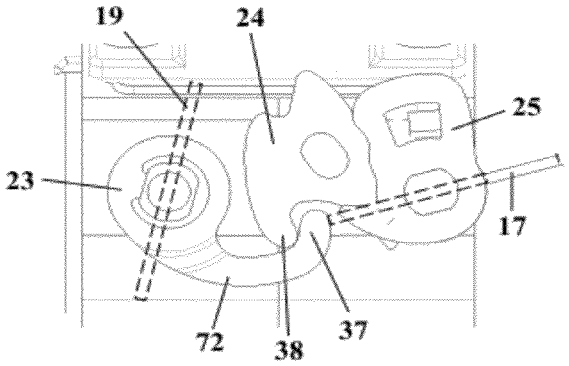
FIG. 7 shows the carburetor of FIG. 2 in locked position.
Figure 8:
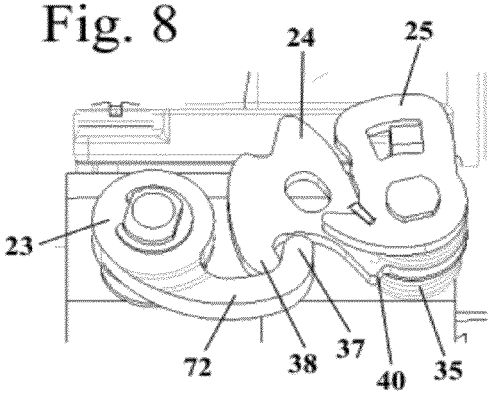
FIG. 8 is a perspective side view of the carburetor in the position of FIG. 7.
Figure 9:
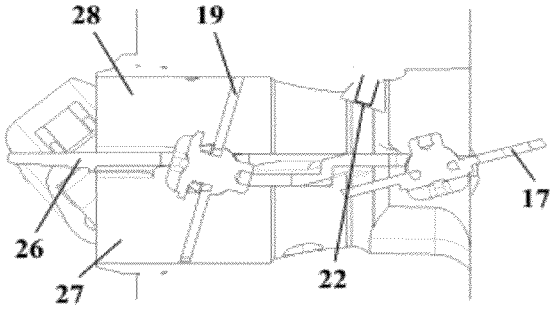
FIG. 9 is a section view of the carburetor in the position of FIG. 7.

FIGS. 7 to 9 show the locked position of throttle lever 23 and choke lever 24. In the position illustrated in FIGS. 7 to 9, the operating state selector 11 has been pivoted from the idle position (FIG. 2) without prior to this actuating the trigger 13 and thereby moving the throttle lever 23 out of the pivot range of the choke lever 24. The choke lever 24 has a locking section 38 that is embodied as a nose facing the hook-shaped section 72 and engaging the short leg 37; it hooks on the hook-shaped section 72 and in this way prevents further opening of the choke valve 17. The choke valve 17 can be opened only to the extent that it reaches the position illustrated in FIG. 9. The locked position 42 illustrated in FIG. 6 cannot be reached. Without prior actuation of the trigger 13 it is thus impossible to shift into the start position.

Figure 10:
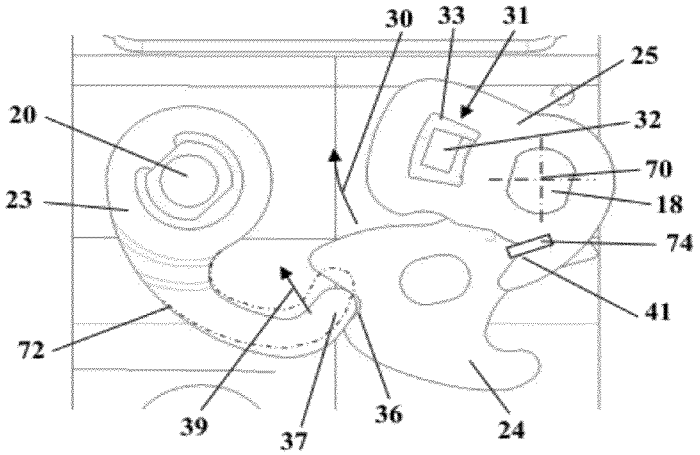
FIG. 10 is a schematic illustration of the deformation of the throttle lever upon release of the start position of FIG. 6.

The illustrated carburetor 9 has an emergency shut-off function. In this way, release of the locked position 42 by actuation of the operating state selector 11 and thus by pivoting of the choke lever 24 is possible. As illustrated in FIG. 10, the throttle lever 23 is of an elastic configuration. For this purpose, the throttle lever 23 is at least partially, in particular completely, made of plastic material, in particular POM. The plastic material of which the throttle lever 23 is formed is advantageously substantially shape-stable and elastic. After deformation the throttle lever 23 thus regains its original shape. When the choke lever 24 is pivoted in the direction of arrow 30, the locking recess 36 is pushed against the short leg 37 of the throttle lever 23 and deforms the hook-shaped section 72 in the direction of arrow 39, as indicated in FIG. 10 by the dash-dotted line. The choke lever 24 can thus pivot past the throttle lever 23. In this way, release of the start position is possible by means of the operating state selector 11, that is, without actuation of the trigger 13.

Usually, the start position that is shown in FIG. 6 can be released upon actuation of the accelerator lever (trigger) 13, i.e., by pivoting the throttle lever 23 in FIG. 6 in downward direction, i.e., in clockwise direction. As soon as the locking action has been released, the choke valve 17 as a result of spring action returns into its completely open position. When the operator releases the accelerator lever 13, the throttle valve 19 will pivot into the idle position as a result of the spring force.

Figure 11:
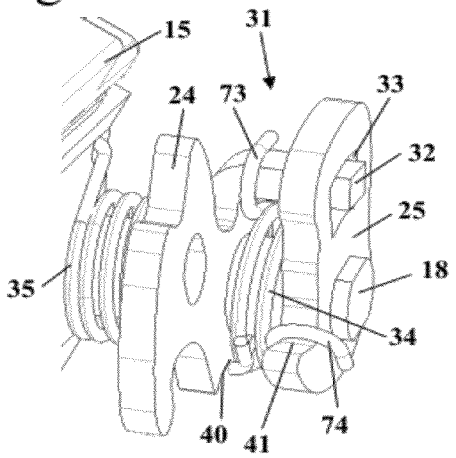
FIG. 11 is a perspective illustration of choke lever and intermediate lever of the carburetor.
Figure 12:
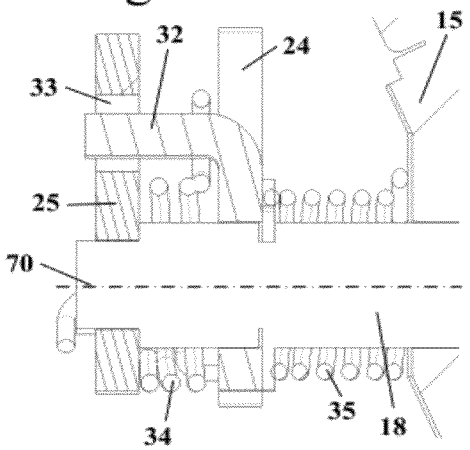
FIG. 12 is a section of the choke shaft in the area of intermediate lever and choke lever.

FIGS. 11 and 12 show the configuration of the choke lever 24 and intermediate lever 25 in detail. The two levers are connected to each other by a coupling device 31 that enables a limited relative movement between the two levers. The two levers are moreover coupled in circumferential direction relative to the axis of rotation 70 of the choke shaft 18 by means of a coupling spring 34. The coupling spring 34 is hooked with a first end 73 on a laterally projecting pin 32 of the choke lever 24. The pin 32 can be bent during production of the choke lever 24 as a bent sheet metal part from sheet metal; it extends away from the choke lever 24 into the plane of the intermediate lever 25. The intermediate lever 25 has an opening 33 into which the pin 32 projects. As shown e.g. in FIG. 10, the extension of the pin 32 in circumferential direction relative to the axis of rotation 70 is smaller than the opening 33 so that the pin 32 is secured with play in the opening 33 and is movable to a limited extent in both rotational directions. The choke lever 24 is supported by means of spring 35 on the carburetor housing 15; the spring forces the choke lever 24 in the direction toward the completely open position of the choke valve 17. The coupling spring 34 in the illustrated embodiment is stronger than the spring 35, i.e., has a greater spring constant. The spring 35 allows for compensation of tolerances between the throttle lever 23 and the choke lever 24 so that a safe locking action in the locked position 42 can be ensured. At the same time, the coupling spring 34 ensures that the choke valve 17 in the locked position 42 is completely closed. The choke lever 24 and the intermediate lever 25 are comprised advantageously of metal, in particular sheet metal. The opening 33 enables a limited movement of the pin 32 in both rotational directions. Since in both rotational directions to only a limited relative movement is possible, the choke lever 24 can be actuated by means of the intermediate lever 25 in both directions. By means of the intermediate lever 25 a rotation of the choke lever 24 for locking as well as for release of the locking action for emergency release is possible.

As shown in FIG. 11, the second end 74 of the coupling spring 35 is hooked on a projection 41. The coupling spring 34 is embodied such that it secures the intermediate lever 25 also in axial direction of the choke shaft 18. The spring 35 is hooked on the choke element 24 on a projection 41, also illustrated in FIG. 8, and is supported with its other end on the carburetor housing 15.

Figure 13:
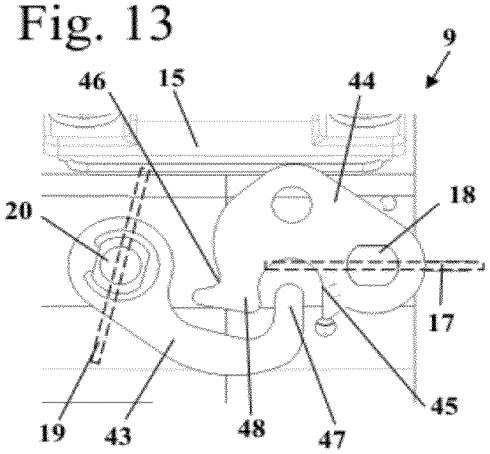
FIG. 13 is a side view of an embodiment of a carburetor in idle position.

In the FIGS. 13 to 17, an embodiment of a carburetor 9 is illustrated in which a choke lever 44 is arranged fixedly on the choke shaft 18. A throttle lever 43 is fixedly arranged on the throttle shaft 20. Same reference numerals identify elements that correspond to each other in all Figures. The throttle lever 43 is hook-shaped and has a short leg 47 interacting with the choke lever 44. In FIG. 13 the idle position is illustrated in which the choke lever 44 and throttle lever 43 are not in engagement with each other. The leg 47 is positioned at a spacing in a recess 45 of the choke lever 44. A locking section 48 projects into the area that is enclosed by the throttle lever 43.

Figure 14:
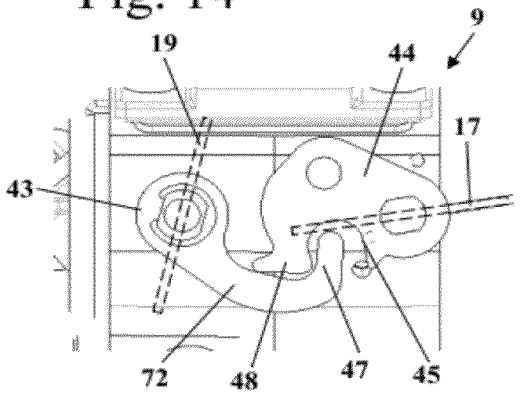
FIG. 14 shows the carburetor of FIG. 13 in locked position.

FIG. 14 shows the carburetor 9 in the locked position. The choke lever 44 has been pivoted without prior pivoting of the throttle lever 43. The locking section 48 is resting on the hook-shaped section of the throttle lever 43. The two levers engage each other and block each other mutually so that no further pivoting of the choke lever 44 is possible.

Figure 15:
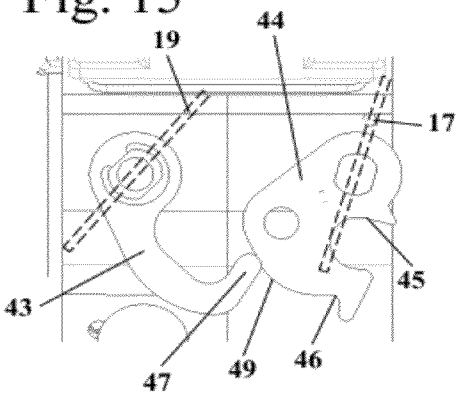
FIG. 15 shows the carburetor of FIG. 13 in choke position.
Figure 16:
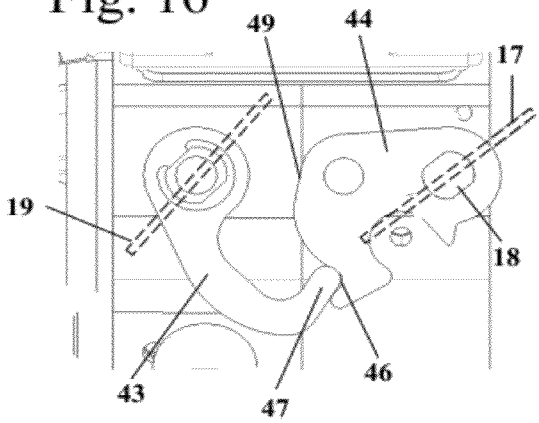
FIG. 16 shows the carburetor of FIG. 13 in start position.
Figure 17:
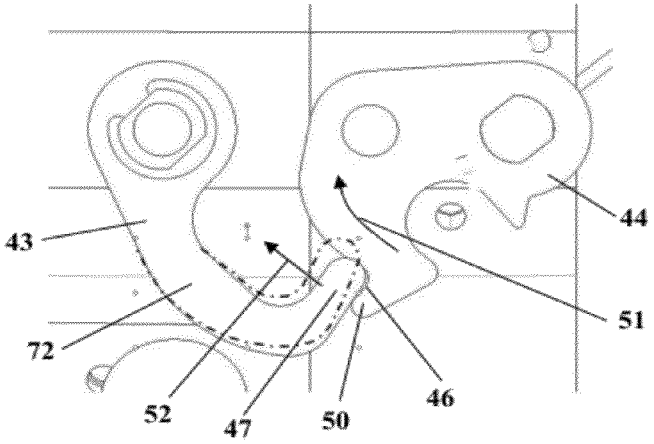
FIG. 17 is a schematic illustration of the carburetor upon release from the start position shown in FIG. 16.

FIG. 15 shows the carburetor 9 in a choke position. In order to reach this position, the operator must first actuate the accelerator lever (trigger) 13 and in this way move the throttle lever 43 out of the pivot range of the choke lever 44. Subsequently, the operating state selector 11 can be pivoted into the choke position. In this position, the leg 47 of the throttle lever 43 rests against a contact surface 49 of the choke lever 44. In this position, the choke lever 44 and the throttle lever 43 are secured by a locking action, not illustrated, of the operating state selector 11. From this position, the operating state selector 11 can be shifted into a start position illustrated in FIG. 16. During the shifting action from the choke position into the start position, the leg 47 glides along the contact surface 49 until it comes to rest in a locking recess 46 of the choke lever 44. In the locking recess 46 the throttle lever 43 and the choke lever 44 mutually block each other because both levers are spring-loaded in opposite directions. For release of the start position the accelerator lever (trigger) 13 can be actuated and in this way the throttle lever 43 can be pivoted clockwise in FIG. 16. In this way, the leg 47 is moved out of the area of the locking recess 46 and the choke lever 44 is returned by a spring of the choke shaft 18, which spring is not illustrated in FIG. 16, into the completely open position. Alternatively, as illustrated in FIG. 17, the locking action can be released by an emergency release action, namely by moving the operating state selector 11 into the idle position. In this way, a nose 50 delimiting the locking recess 46 is pressed against the leg 47 of the throttle lever 43 and deforms it, as illustrated in FIG. 17 by the arrow 52 and the dash-dotted line. The choke lever 44 is thus pivoted in the direction of arrow 51. By means of the elastic deformation of the elastic hook-shaped section 72 of the throttle lever 43, a release of the locking action is possible.

The throttle lever 42 is comprised also of plastic material, in particular of POM, and the choke lever 44 is made of metal.

Figure 18:
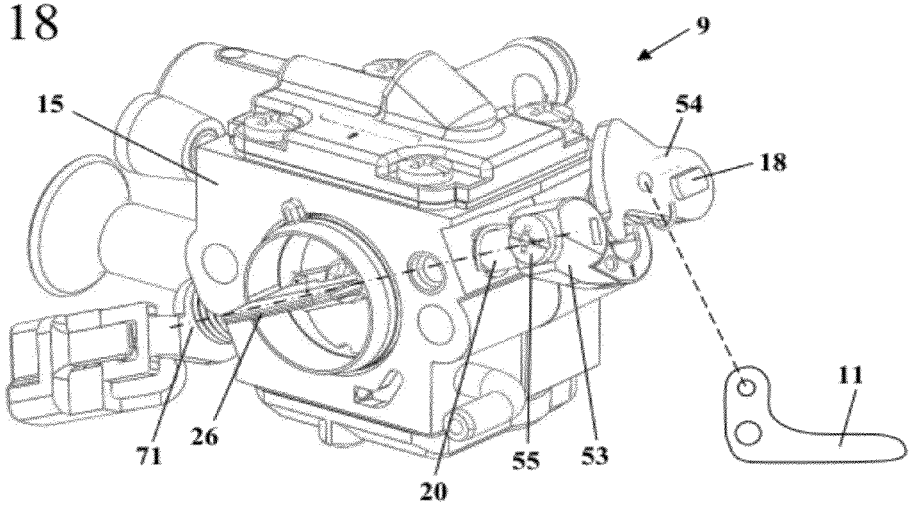
FIG. 18 is a perspective illustration of an embodiment of a carburetor in idle position.
Figure 19:
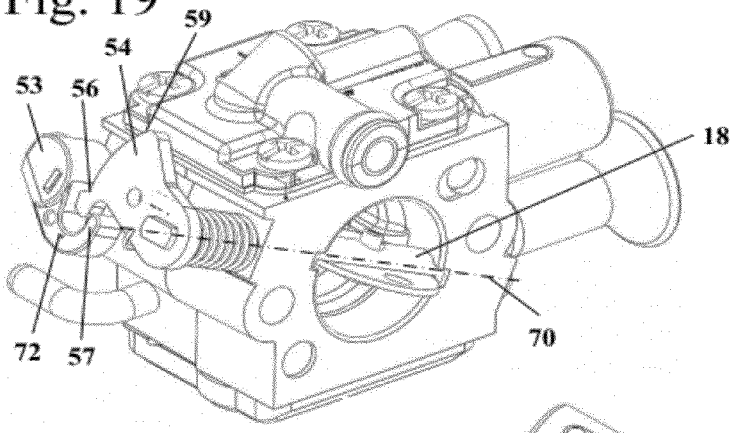
FIG. 19 is another perspective illustration of the embodiment of the carburetor in idle position.

FIGS. 18 to 22 show a further embodiment of the carburetor 9. The throttle shaft 20 is pivotable about pivot axis 71. On the throttle shaft 20 an elastic throttle lever 53 is fixedly arranged. The throttle lever 53 is secured on the throttle shaft 20 by means of a fastening screw 55 that extends approximately radially relative to the pivot axis 71. A shape-stable choke lever 54 is fixedly secured on the choke shaft 18. The operating state selector 11, schematically illustrated in FIG. 18, is acting on the choke shaft 54. FIGS. 18 and 19 show the arrangement in idle position. Choke lever 54 and throttle lever 53 are not in engagement in this position. The throttle lever 53 has a hook-shaped section 72 that is approximately L-shaped and whose short leg 57 can lock with the choke lever 54 in order to adjust a start position of the throttle valve 19 and the choke valve 17. For this purpose, on the circumference of the choke lever 54 a locking recess 56 is formed. The choke lever 54 has moreover a contact surface 59 on which the throttle lever 53 can rest in a choke position of the arrangement.

Figure 20:
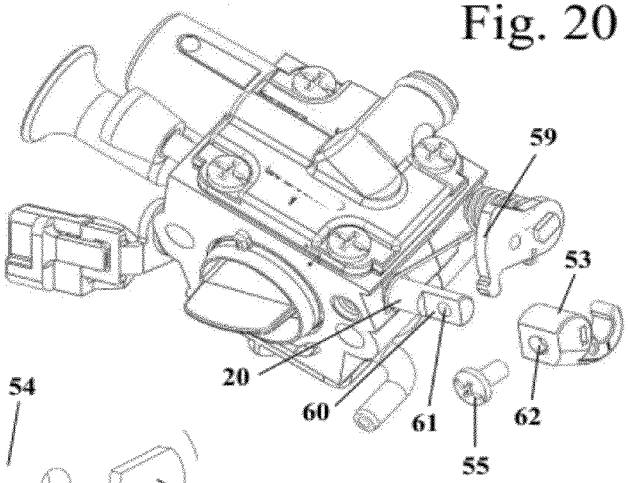
FIG. 20 is an exploded view of the throttle lever and throttle shaft of the carburetor of FIG. 19.

As shown in FIG. 20, the throttle shaft 20 has a flat section 60 across which the throttle lever 53 engages. The throttle lever 53 has an appropriate recess so that the throttle lever 53 is secured with form fit on the throttle shaft 20. For fixation the throttle shaft 20 has in the area of the flat section 60 a threaded bore 61 and the throttle lever 53 has an opening 62. The fastening screw 55 is pushed through the opening 62 and is screwed into the threaded bore 61. In this way, the throttle lever 53 is secured on the throttle shaft 20.

Figure 21:
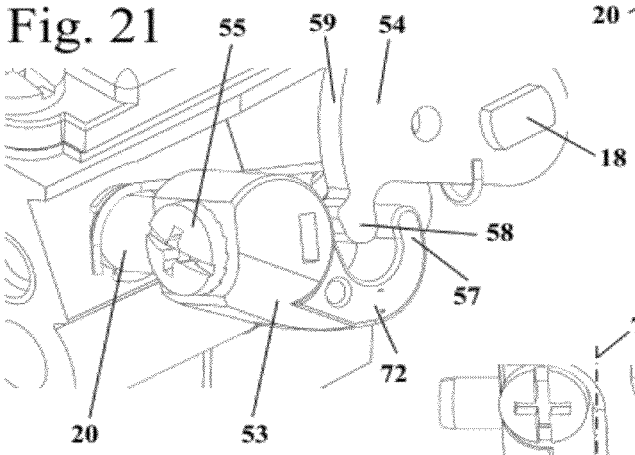
FIG. 21 is an enlarged illustration of the throttle lever and choke lever.

As shown in FIG. 21, the choke lever 54 has a locking section 58 which in the illustrated idle position projects into the area enclosed by the hook-shaped section 72 of the throttle lever 53. When the choke lever 54 is actuated without pivoting of the throttle lever 53, the locking section 58 hooks in the hook-shaped section 72 and is thereby blocked so that a further pivoting of the choke lever 54 is not possible.

Figure 22:
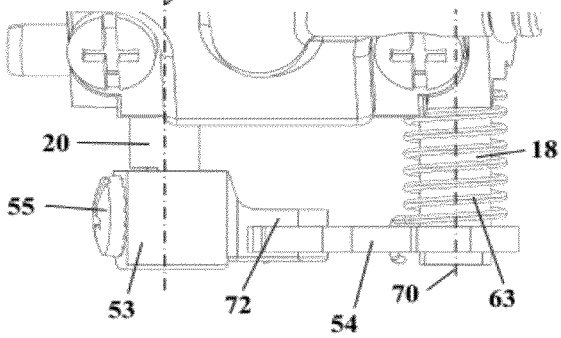
FIG. 22 is a plan view onto the carburetor in the area of the throttle lever and the choke lever.

As illustrated in FIG. 22, the choke shaft 18 is spring-loaded by a spring 63 in the direction toward the completely open position of the choke valve 17. The extension of the choke lever 54 in the direction of the pivot axes 70 and 71 of choke shaft 18 and throttle shaft 20 is less than that of the hook-shaped section 72 of the throttle lever 53. The throttle lever 53 is in particular made completely of an elastic shape-stable plastic material, especially POM, but at least in the area of the hook-shaped section 72 is made of the elastic shape-stable plastic material. The choke lever 54 is comprised advantageously of a shape-stable material such as metal that under the forces occurring in regular operation is non-elastic. In the locked position with locking action between the throttle lever 53 and the choke lever 54 (locked position not illustrated in the Figures), the choke lever 54 can be returned by means of the operating state selector 11 by elastic deformation of the throttle lever 53 into the idle position so that an emergency release is enabled.

In all embodiments, the locking position in regular operation is released by rotation of the throttle shaft in the opening direction of the throttle element, i.e., upon acceleration (trigger 13). The locking position is alternatively releasable by rotation of the choke shaft in opening direction of the choke element. When releasing the locked position by rotation of the choke shaft in the opening direction no further acceleration (trigger actuation) is required. The locked position is therefore either releasable by rotation of the throttle shaft in opening direction of the throttle element or by rotation of the choke shaft in opening direction of the choke element.

The specification incorporates by reference the entire disclosure of German priority document 10 2010 048 773.2 having a filing date of Oct. 16, 2010.

While specific embodiments of the invention have been shown and described in detail to illustrate the inventive principles, it will be understood that the invention may be embodied otherwise without departing from such principles.

What is claimed is:

1. A carburetor comprising:

a throttle element that is rotatably supported on a throttle shaft;

a choke element that is rotatably supported on a choke shaft;

a first coupling element that is fixedly connected to said throttle shaft;

a second coupling element that is connected to said choke shaft;

wherein said first coupling element and said second coupling element in at least one locked position define a start position of said throttle element and said choke element;

wherein said at least one locked position is released by rotation of said throttle shaft in opening direction of said throttle element;

wherein said at least one locked position is released by rotation of said choke shaft in opening direction of said choke element;

wherein one of said first and said second coupling elements is an at least partially elastic coupling element;

wherein, upon rotation of said choke shaft from said at least one locked position into an open position, said at least partially elastic coupling element is elastically deformed and releases said at least one locked position effected between said first and second coupling elements.

2. The carburetor according to claim 1, wherein said at least partially elastic coupling element has a hook-shaped section that is elastic.

3. The carburetor according to claim 1, wherein said at least partially elastic coupling element is comprised of plastic material.

4. The carburetor according to claim 1, wherein the other one of said first and second coupling elements is shape-stable under forces occurring in regular operation.

5. The carburetor according to claim 4, wherein said first coupling element is elastic and said second coupling element is shape-stable.

6. The carburetor according to claim 1, wherein said first coupling element has a locking contour interacting with a locking section of said second coupling element, wherein, when said throttle element is closed, said locking contour blocks said second coupling element and prevents rotation of said choke shaft in said opening direction.

7. The carburetor according to claim 6, wherein said at least partially elastic coupling element has a hook-shaped section that is elastic and said hook-shaped section provides said locking contour.

8. The carburetor according to claim 1, wherein on said choke shaft an intermediate lever is fixedly arranged and said second coupling element is rotatably supported on said choke shaft and coupled with said intermediate lever by a coupling device, wherein said coupling device enables a limited movability of said second coupling element relative to said immediate lever in at least one direction.

9. The carburetor according to claim 8, wherein said coupling device limits the movability of said second coupling element relative to said intermediate lever in both rotational directions relative to said choke shaft.

10. The carburetor according to claim 8, wherein said coupling device is a pin that projects into an opening wherein an extension of said pin in a circumferential direction of said choke shaft is smaller than an extension of said opening.

11. The carburetor according to claim 10, wherein said pin is provided on said second coupling element and said opening is provided on said intermediate lever.

12. The carburetor according to claim 8, comprising a coupling spring that is arranged in a direction of action between said second coupling element and said intermediate lever.

13. The carburetor according to claim 12, wherein said coupling spring secures said intermediate lever in an axial direction of said choke shaft.

14. The carburetor according to claim 8, wherein said intermediate lever and said second coupling element are comprised of shape-staple material.

15. The carburetor according to claim 1, wherein said first coupling element is secured on said throttle shaft by a fastening screw.

16. The carburetor according to claim 1, wherein said throttle element and said choke element open in identical rotational direction.

* * * * *